US007333758B2

(12) United States Patent
Munakata et al.

(10) Patent No.: US 7,333,758 B2
(45) Date of Patent: Feb. 19, 2008

(54) IMAGE FORMING APPARATUS

(75) Inventors: Manabu Munakata, Nagano (JP); Yujiro Nomura, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/334,738

(22) Filed: Jan. 18, 2006

(65) Prior Publication Data

US 2006/0182472 A1 Aug. 17, 2006

(30) Foreign Application Priority Data

Jan. 19, 2005 (JP) ..... P2005-011320
Jan. 19, 2005 (JP) ..... P2005-011321
Jan. 19, 2005 (JP) ..... P2005-011322
Jan. 19, 2005 (JP) ..... P2005-011323

(51) Int. Cl.
*G03G 15/01* (2006.01)

(52) U.S. Cl. ..... 399/299; 399/300; 399/301; 399/302

(58) Field of Classification Search ..... 399/299, 399/300, 302, 31, 301
See application file for complete search history.

(56) References Cited

U.S. PATENT DOCUMENTS 6,148,168 A * 11/2000 Hirai et al. ..... 399/301
6,324,374 B1 * 11/2001 Sasamoto et al. ..... 399/298
2003/0053819 A1 * 3/2003 Nomura et al. ..... 399/110
2004/0234287 A1 * 11/2004 Nishida et al. ..... 399/66
2006/0088345 A1 * 4/2006 Koizumi ..... 399/301

FOREIGN PATENT DOCUMENTS

JP 2603254 1/1997
JP 09-304994 11/1997

* cited by examiner

*Primary Examiner*—David M. Gray
*Assistant Examiner*—Geoffrey T Evans
(74) *Attorney, Agent, or Firm*—Hogan & Hartson LLP

(57) ABSTRACT

An image forming apparatus capable of changing over between black printing and color printing with an intermediate transfer belt being brought into contact with and separated from photoconductors by means of a black transfer member and a three-color-integrated color transfer member. The image forming apparatus has a registration mark former for forming registration marks on the intermediate transfer belt, a registration sensor for reading the registration marks, and a controller for controlling the registration mark former based on the registration marks read by the registration sensor, so as to adjust registration. The controller has an adjustment mode to adjust registration between black and color.

18 Claims, 8 Drawing Sheets

IMAGE FORMING APPARATUS

TECHNICAL FIELD OF THE INVENTION

The present invention relates to an image forming apparatus capable of changing over between black printing and color printing with an intermediate transfer belt being brought into contact with and separated from photoconductors by means of a black transfer member and a three-color-integrated color transfer member. The present invention also relates to an image forming apparatus provided with a black image forming cartridge and an image forming cartridge in which image formers of plurality of colors are integrated.

BACKGROUND OF THE INVENTION

In a tandem type full-color image forming apparatus in the related art, there has been proposed a technique for preventing misregistration such as misregistration in a conveyance direction of an intermediate transfer belt, misregistration in a scanning direction, a variation of an oblique inclination, a variation of a magnification error, etc. as follows. That is, a reflector is disposed in a light beam optical path from a scanning optics to a photoconductor drum so that the position of the reflector can be adjusted. The positions of marks on the intermediate transfer belt are detected. Misregistration factors among respective images are corrected in accordance with the detection result (Japanese Patent No. 2,603,254).

In Japanese Patent No. 2,603,254, marks of four colors are formed whenever misregistration factors among respective images are to be corrected. Accordingly, there is a problem that the consumption of color toners increases and it takes much processing time to correct misregistration.

Further, there has been proposed a tandem type full-color image forming apparatus in which four image forming cartridges can be removably attached to a body unit. In each image forming cartridge, a photoconductor drum, a cleaner, a charger, a developing unit, etc. are incorporated integrally and formed into a unit. When the image forming cartridges are inserted or removed for exchanging expendables, misregistration is apt to occur due to the exchange. In order to improve this point, there has been proposed an image forming apparatus arranged out of two kinds of image forming cartridges one of which is a monochrome image forming cartridge and the other of which is a three-color-integrated image forming cartridge (JP-A-9-304994)

When color misregistration among images of respective colors is to be corrected in an image forming apparatus as disclosed in JP-A-9-304994, registration is usually controlled with registration marks of four colors formed on an intermediate transfer belt. Accordingly, there is a problem that the consumption of color toners increases and it takes much processing time to correct color misregistration.

The present invention is aimed at solution to the foregoing problem. A first object of the invention is to provide an image forming apparatus capable of changing over between black printing and color printing, in which registration adjustment can be performed with suppressed toner consumption and shortened processing time.

In order to attain the first object, a first embodiment of the invention provides an image forming apparatus capable of changing over between black printing and color printing with an intermediate transfer belt being brought into contact with and separated from photoconductors by means of a black transfer member and a three-color-integrated color transfer member, the image forming apparatus including: a registration mark former for forming registration marks on the intermediate transfer belt; a registration sensor for reading the registration marks; and a controller for controlling the registration mark former based on the registration marks read by the registration sensor, so as to adjust registration; wherein the controller has an adjustment mode to adjust registration between black and color.

In addition, the controller may have a first adjustment mode in which a registration mark of one of yellow, magenta and cyan and a registration mark of black are formed individually so as to adjust registration between black and color, and a second adjustment mode in which registration marks of all the colors are formed to adjust registration, and the controller may change over between the first adjustment mode and the second adjustment mode so as to adjust registration.

Further, the controller may adjust registration using a registration mark of black and a registration mark of a color whose photoconductor is located in a position closest to a black photoconductor.

Further, the controller may change over the color whose registration marks should be formed, in accordance with remaining amounts of toners.

According to the first embodiment of the invention, the image forming apparatus having a black transfer member and a three-color-integrated color transfer member has an adjustment mode to adjust registration between black and color in which misregistration is apt to occur. Accordingly, the consumption of color toners can be suppressed, and the processing time for registration adjustment can be shortened.

In addition, registration adjustment is performed by changing over between the first adjustment mode in which a registration mark of one of yellow, magenta and cyan and a registration mark of black are formed individually so as to adjust registration between black and color, and the second adjustment mode in which registration marks of all the colors are formed to adjust registration. Accordingly, the consumption of color toners can be suppressed, and the processing time for registration adjustment can be shortened.

Further, in the first adjustment mode, registration adjustment is performed with a printed registration mark of black and a registration mark of a color whose photoconductor is located in a position closest to a black photoconductor. Accordingly, the registration adjustment between black and color can be performed easily.

Moreover, the color whose registration marks should be formed is changed over in accordance with the remaining amounts of toners. Accordingly, lopsided consumption of color toner can be suppressed.

A second object of the invention is to provide an image forming apparatus having a black image forming cartridge and an image forming cartridge in which image formers of a plurality of colors are integrated, in which registration adjustment can be performed with suppressed toner consumption and shortened processing time.

In order to attain the second object, a second embodiment of the invention provides an image forming apparatus including: a black image forming cartridge; an image forming cartridge in which image formers of a plurality of colors are integrated; a registration mark former for forming registration marks on an intermediate transfer belt; a registration sensor for reading the registration marks; and a controller for controlling the registration mark former based on the registration marks read by the registration sensor, so as to adjust registration; wherein the controller has an adjustment mode to adjust registration between black and color.

In addition, the controller may have a first adjustment mode in which a registration mark of one of yellow, magenta and cyan and a registration mark of black are formed individually so as to adjust registration between black and color, and a second adjustment mode in which registration marks of all the colors are formed to adjust registration, and the controller may change over between the first adjustment mode and the second adjustment mode so as to adjust registration.

Further, the controller may adjust registration using a registration mark of black and a registration mark of a color whose image former is located in a position closest to the black image forming cartridge in the first adjustment mode.

Moreover, the controller may change over the color whose registration marks should be formed, in accordance with remaining amounts of toners.

According to the second embodiment of the invention, the image forming apparatus having a black image forming cartridge and an image forming cartridge in which image formers of a plurality of colors are integrated, has an adjustment mode for performing registration adjustment between black and color in which misregistration is apt to occur. Accordingly, the consumption of color toners can be suppressed, and the processing time for registration adjustment can be shortened.

In addition, registration adjustment is performed by changing over between the first adjustment mode in which a registration mark of one of yellow, magenta and cyan and a registration mark of black are formed individually so as to adjust registration between black and color, and the second adjustment mode in which registration marks of all the colors are formed to adjust registration. Accordingly, the consumption of color toners can be suppressed, and the processing time for registration adjustment can be shortened.

Further, in the first adjustment mode, registration adjustment is performed with a printed registration mark of black and a registration mark of a color whose image former is located in a position closest to the black image forming cartridge. Accordingly, the registration adjustment between black and color can be performed easily.

Moreover, the color whose registration marks should be formed is changed over in accordance with the remaining amounts of toners. Accordingly, lopsided consumption of color toner can be suppressed.

DETAILED DESCRIPTION OF THE INVENTION

A first embodiment of the invention will be described below with reference to the accompanied drawings.

Figure 1:
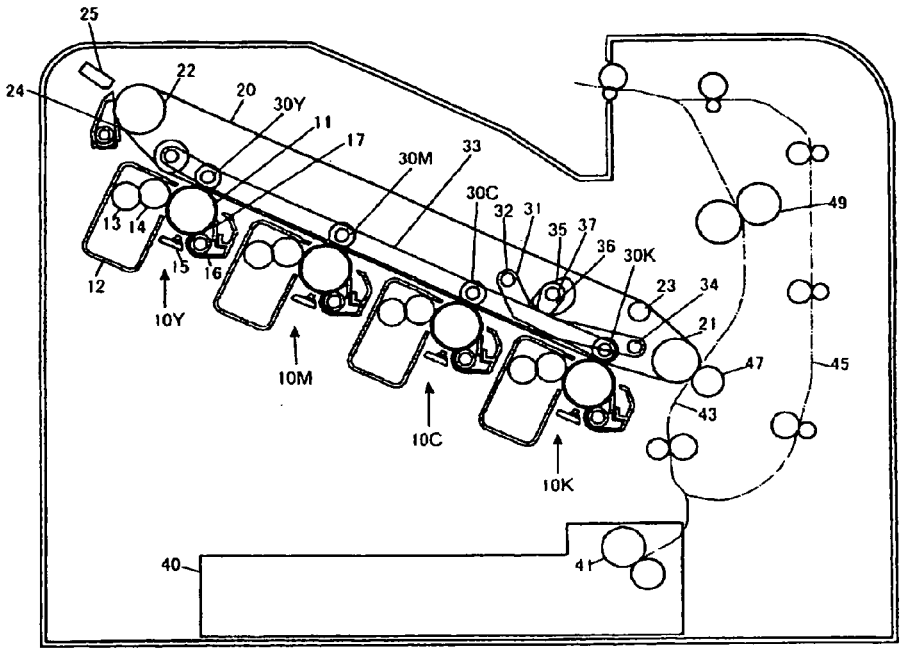
FIG. 1 is a diagram for explaining the schematic configuration of an image forming apparatus according to a first embodiment of the invention.
Figure 2:
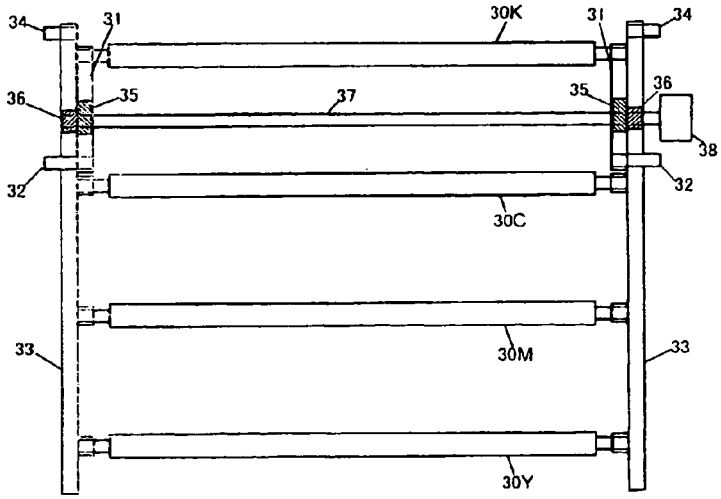
FIG. 2 is a plan view for explaining the configuration of contact/separation units.
Figure 3A:
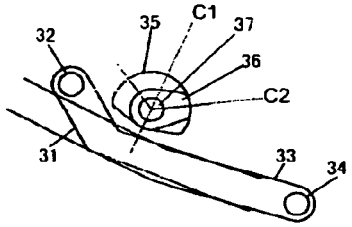
FIGS. 3A to 3C are diagrams for explaining a cam for driving a movable lever.
Figure 3B:
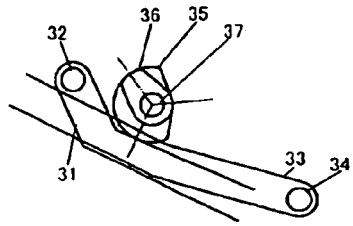
Figure 3C:
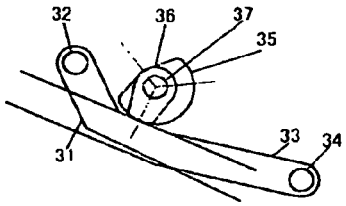

FIG. 1 is a view showing a first embodiment of a tandem type color image forming apparatus to which the invention is applied. FIG. 2 is a plan view for explaining the configuration of a contact/separation unit. FIGS. 3A-3C are views for explaining a cam for driving a lever.

In FIG. 1, in the image forming apparatus according to this embodiment, an endless intermediate transfer belt 20 is stretched between a driving roller 21 and a driven roller 22, and predetermined tension is applied to the intermediate transfer belt 20 by a tension roller 23. Four color photoconductor units 10 (a black photoconductor unit 10K, a cyan photoconductor unit 10C, a magenta photoconductor unit 10M and a yellow photoconductor unit 10Y) are disposed in the length direction of the intermediate transfer belt 20. An intermediate belt cleaner 24 is provided in a position opposed to the driven roller 22 while a registration sensor 25 for detecting a printing position is provided. Each color photoconductor unit 10 has a developing unit 12 having a toner supply roller 13 and a developing roller 14, an exposure unit 15, a charger 16 and a photoconductor cleaner 17 around a roller-like photoconductor 11.

A primary transfer roller 30 for each color (a black primary transfer roller 30K, a cyan primary transfer roller 30C, a magenta primary transfer roller 30M, a yellow primary transfer roller 30Y) is disposed in a position opposed to each color photoconductor so as to put the intermediate transfer belt 20 therebetween. A secondary transfer roller 47 is provided in a secondary transfer position opposed to the driving roller 34 so as to put the intermediate transfer belt 20 therebetween.

In each color photoconductor unit 10, the photoconductor 11 is charged uniformly to predetermined potential by the charger 16, and image exposure is then performed on the photoconductor 11 by the exposure unit 15 so that a pictorial electrostatic latent image is formed on the photoconductor. The electrostatic latent image is developed by the developing roller 14 so as to form a toner image. The toner image is primarily transferred onto the intermediate transfer belt 20. Residual untransferred toner is cleaned up by the photoconductor cleaner 17. On the other hand, a paper feed cassette 40 is provided in a lower portion of the apparatus.

Paper fed out by a feed roller 41 is conveyed through a conveyance path 43. In a secondary transfer position, toner images on the intermediate transfer belt are transferred onto the paper in a lump. After the secondary transfer, the toner images are fixed to the paper by a fixing unit 49, and the paper is then discharged to a tray on the top of the apparatus. In the case of duplex printing, the paper having the toner images printed on its front surface is conveyed to the secondary transfer position through a conveyance path 45, and toner images are transferred to the rear surface of the paper. After that, the toner images are fixed by the fixing unit 49, and the paper is discharged to the tray on the top of the apparatus.

In this embodiment, one end of each movable lever (black contact/separation lever) 31 is supported on a support shaft 32 so that the movable lever 31 rotates around the support shaft. The movable lever 31 is urged by a not-shown spring member so as to be separated from the intermediate transfer belt. The black primary transfer roller 30K is driven at the other end of the movable lever 31. On the other hand, one end of each movable lever (color contact/separation lever) 33 is supported on a support shaft 34 so that the movable lever 33 rotates around the support shaft. The movable lever 33 is urged by a not-shown spring member so as to be separated from the photoconductor and the intermediate transfer belt. The color primary transfer rollers (the cyan primary transfer roller 30C, the magenta primary transfer roller 30M and the yellow primary transfer roller 30Y) are driven integrally by the movable lever 33.

As shown in FIG. 2, the black contact/separation levers 31 and the color contact/separation levers 33 are provided in the opposite ends of the respective color primary transfer rollers 30 (the black primary transfer roller 30K, the cyan primary transfer roller 30C, the magenta primary transfer roller 30M and the yellow primary transfer roller 30Y) so as to support the respective color primary transfer rollers 30. A cam shaft 37 is provided in an intermediate position between the black primary transfer roller 30K and a color transfer roller (the cyan primary transfer roller 30C in this embodiment) disposed in a position closest to the black primary transfer roller 30K. The cam shaft 37 is driven by a drive source 38 constituted by a motor or the like. In each end of the cam shaft 37, a black contact cam 35 for engaging with the black contact/separation lever 31 and a color contact cam 36 for engaging with the color contact/separation lever 33 are provided so as to drive the black contact/separation lever 31 and the color contact/separation lever 33 against the spring members respectively due to the rotation of the cam shaft 37. Thus, each color primary transfer roller 30 is brought into contact with and separated from the intermediate transfer belt 20.

In this embodiment, the support shaft 32 and the support shaft 34 are provided on the opposite sides to each other with respect to the cam shaft 37. The black contact/separation lever 31 and the color contact/separation lever 33 extend from these support shafts respectively so as to cross each other and overlap each other. By such a configuration, the total length of the contact/separation unit including the black and color transfer rollers, the two movable levers and the drive source of the cam shaft can be shortened. As shown in FIG. 1, the total length can be made shorter than the length between the driving roller and the driven roller and can be made shorter than the total length of the respective color photoconductor units disposed in the length direction of the intermediate transfer belt. Thus, the contact/separation unit can be received in a space in the intermediate transfer belt.

Further, the intermediate transfer belt is inclined with respect to the horizon, and the cam shaft 37 is disposed on or near the perpendicular bisector of a straight line connecting the black primary transfer roller 30K and the cyan primary transfer roller 30C. The Y, M and C transfer rollers are driven integrally while being supported on one and the same color contact/separation lever 33 so that the printing positions of Y, M and C can be kept accurate. However, the black contact/separation lever is provided separately from the color contact/separation lever. Misregistration is therefore apt to occur between the printing positions of color and black. The cam shaft 37 is therefore disposed at equal distances from the black primary transfer roller 30K and the cyan primary transfer roller 30C so that the surface shape of the contact portion between the cam and each movable lever is made substantially the same as that between the cam and the other movable lever. As a result, the moving trajectory of the black primary transfer roller and the moving trajectory of the cyan primary transfer roller become substantially plane-symmetric with respect to the cam shaft so that the displacements thereof become equal to each other. Thus, misregistration between the printing positions of black and cyan, hence misregistration between the printing positions of black and each color Y, M, C can be prevented.

The color contact/separation lever 33 is designed to be parallel to a tangent to the cyan photoconductor 11C, the magenta photoconductor 11M and the yellow photoconductor 11Y when the intermediate transfer belt is brought into contact with the color photoconductors 11 by the color transfer rollers respectively. As a result, the photoconductors of the respective colors abut against the intermediate transfer belt at the same timing. If there is a variation among the contact timings of the color photoconductors, a photoconductor first abutting against the intermediate transfer belt will give an impact to the intermediate transfer belt so as to vibrate the intermediate transfer belt and generate a variation in printing position accuracy. In this embodiment, however, such a phenomenon can be prevented because the respective color photoconductors abut against the intermediate transfer belt at the same timing.

Next, the cam structure for driving the two movable levers independently will be described with reference to FIGS. 3A-3C. As illustrated, a black contact cam 35 has substantially a circular shape partially cut away in axial section. The cam portion other than the cut-away portion (non-cam portion) abuts against the black contact/separation lever so as to drive the black contact/separation lever. The cam surface which is a contact surface with the lever extends over an angle larger than 180° around the cam shaft. Accordingly, when the cam shaft is rotated so that the non-cam portion ranging over an angle smaller than 180° faces the black contact/separation lever 31, the black contact cam 35 is in no contact with the black contact/separation lever 31. Thus, the intermediate transfer belt does not abut against the black photoconductor. When the cam portion ranging over an angle larger than 180° faces the black contact/separation lever 31, the black contact cam 35 is in contact with the black contact/separation lever 31. Thus, the cam portion pushes down the lever. When the lever is near the position where the pushing distance is maximum, the intermediate transfer belt abuts against the black photoconductor.

On the other hand, the color contact cam 36 is formed to have a cam surface (serving to abut against the color contact/separation lever 33) substantially coinciding with a part of the cam surface of the black contact cam 35 in axial section, and ranging within the angle of the cam surface of the black contact cam 35. A line (color contact cam center line) C2 passing through the center of the cam shaft and passing through the center of the cam surface of the color contact cam 36 corresponds to a position at an angle of approximately 60° with respect to a line (black contact cam center line) C1 passing through the center of the cam shaft and passing through the center of the cam surface of the black contact cam 35.

As described previously, the cam shaft is located substantially on the perpendicular bisector of the straight line connecting the black primary transfer roller and the cyan primary transfer roller. In FIG. 3A, the black contact cam surface is located to be symmetric with respect to the perpendicular bisector (corresponding to the line C1 in FIG. 3A), and the non-cam portion faces the black contact/separation lever. Therefore, the lever is not driven. On the other hand, the color contact cam center line C2 is located one the right side at an angle of 60° with respect to the black contact cam center line. Therefore, the cam surface of the color contact cam 36 within the cam surface of the black contact cam 35 does not face the color contact/separation lever, either. Thus, the lever is not driven. The intermediate transfer belt is in a standby mode where the intermediate transfer belt does not abut against any color photoconductor.

When the cam shaft is turned counterclockwise by 120° in FIG. 3A, a part of the cam surface of the black contact cam 35 pushes down the black contact/separation lever 31. On the other hand, the cam surface of the color contact cam 36 does not abut against the color contact/separation lever 33 only when the color contact cam center line is rotated by 120°. Thus, the intermediate transfer belt abuts against only the black photoconductor so as to set a monochrome mode (FIG. 3B).

When the cam shaft is turned clockwise by 120° in FIG. 3A, a part of the cam surface of the black contact cam 35 pushes down the black contact/separation lever 31. Further, the cam surface of the color contact cam 36 whose color contact cam center line is located in a position turned clockwise by 60° with respect to the perpendicular bisector also pushes down the color contact/separation lever 33. Thus, the intermediate transfer belt abuts against all the photoconductors so as to set a full color mode (FIG. 3C).

In such a manner, the black contact cam 35 and the color contact cam 36 are rotated coaxially, and controlled to stop in three positions corresponding to the color mode, the monochrome mode and the standby mode by the drive source 38. For example, a stepping motor or a stepping clutch capable of stopping in three positions is used as the drive source 38. In this manner, it is possible to change over among the full color mode, the monochrome mode and the standby mode at an equal rotation angle interval of 120°. The changeover can be performed at a higher speed and in a constant time lag.

Next, registration control in the image forming apparatus for driving the Y, M and C primary transfer rollers integrally by means of the color contact/separation lever as described above will be described with reference to FIGS. 4 and 5A-5B.

Figure 4:
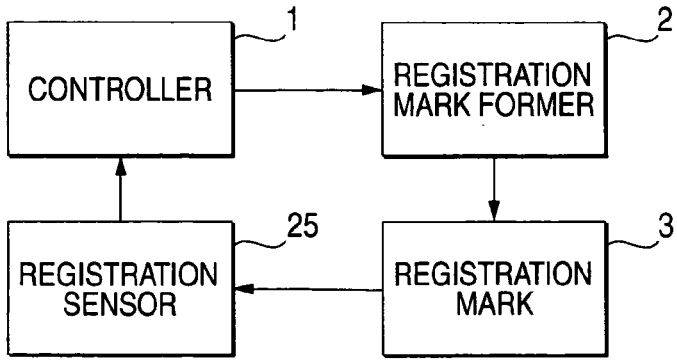
FIG. 4 is a block configuration diagram for registration control.
Figure 5A:
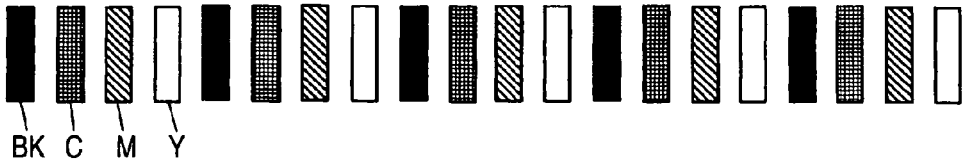
FIG. 5A shows an example of a full color adjustment mode.
Figure 5B:
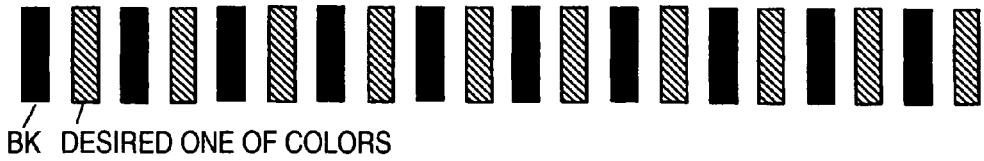
FIG. 5B shows an example of a two-color adjustment mode.

FIG. 4 is a block configuration diagram for the registration control. FIGS. 5A and 5B are diagrams for explaining the registration control.

The controller 1 is a control portion for adjusting registration in the image forming apparatus. The controller 1 is arranged as an independent stand-alone controller or a part of a controller for controlling a process as a whole. Registration adjustment is a process to prevent misregistration among images of respective colors formed on the intermediate transfer belt. For example, assume that exposure timing and driving speed of each color photoconductor, the driving speed of the intermediate transfer belt, etc. are set to form images (registration marks) of the respective colors Y, M, C and Bk at regular intervals on the intermediate transfer belt. In this case, the registration marks 3 actually formed on the intermediate transfer belt are read by the registration sensor 25 having a light emitting portion and a light receiving portion. The controller 1 checks whether the registration marks 3 are formed at regular intervals or not. As a result, when the registration marks of the respective colors are not formed at regular intervals, the controller 1 controls the registration mark forming means (the photoconductor units, the intermediate transfer belt, the intermediate transfer belt driving unit, etc.) so as to make the intervals equal to one another. By this control, for example, the timing of exposure in the exposure unit, the driving speed of each photoconductor, the driving speed of the intermediate transfer belt, etc. are adjusted. Although registration adjustment to form the registration marks at regular intervals has been shown here by way of example, the registration marks does not have to be formed at regular intervals. The registration marks may be formed with a desired pattern, and adjustment may be done to form the pattern conforming to settings. When adjustment can be done thus to form the registration marks conforming to settings, images can be formed without misregistration among the respective colors.

In the image forming apparatus in which the Y, M and C primary transfer rollers are driven integrally by the color contact/separation lever as described in FIGS. 1, 2 and 3A-3C, misregistration among the colors Y, M and C rarely occurs. However, since the black primary transfer roller is driven by the black contact/separation lever different from the color contact/separation lever, misregistration between black and color is apt to occur. Therefore, in this embodiment, an adjustment mode to adjust registration between black and color is provided for adjusting registration between the both.

FIG. 5A shows an example of a full color adjustment mode. Registration adjustment among the respective colors is performed with registration marks of Bk, C, M and Y formed at regular intervals on the intermediate transfer belt. In this case, since the C, M and Y primary transfer rollers are driven integrally by the color contact/separation lever, misregistration rarely occurs. If this adjustment is performed frequently, registration marks of C, M and Y will be formed frequently (e.g. every 50 prints) in spite of good registration accuracy kept among C, M and Y. Thus, toners will be consumed uselessly, and it will take time for processing for the adjustment.

Therefore, as shown in FIG. 5B, there is provided another mode for adjusting registration between black and color in which misregistration is apt to occur due to the different contact/separation levers for the primary transfer rollers. Thus, adjustment is performed between black and a desired one of the colors Y, M and C. For example, registration between black and color is adjusted frequently (e.g. every 50 prints), and the mode is changed over to the full color registration adjustment mode in the ratio of once to several times (e.g. every 500 prints). The color toner consumption can be suppressed by the registration adjustment between black and one of the colors, and the processing time can be also shortened due to adjustment between the two colors as compared with adjustment among the four colors.

In such a manner, registration adjustment is performed by changing over between a first adjustment mode in which registration adjustment between black and color is performed with registration marks of black and one of the colors Y, M and C and a second adjustment mode in which registration adjustment is performed with registration marks of all the colors. Thus, the color toner consumption can be suppressed, and the processing time can be shortened.

In the image forming apparatus in FIGS. 1, 2 and 3A-3C, the color subjected to adjustment with black is preferably cyan. The cyan image former constituted by a photoconductor unit, a primary transfer roller, etc. is disposed in a position closest to the black one. It is therefore easy to increase the registration accuracy. When only the registration adjustment between black and a specific color is performed frequently, the consumption of toner of the specific color increases. It is also necessary to determine the color subjected to adjustment with black, in consideration of the consumption of color toners.

Further, a modified embodiment of the first embodiment will be described below with reference to the accompanied drawings.

In the modified embodiment of the first embodiment, the first adjustment mode in which in which registration adjustment between black and color is performed with registration marks of black and one of the colors Y, M and C is set to a rough adjustment mode and a second adjustment mode in which registration adjustment is performed with registration marks of all the colors is set to a fine adjustment mode. Further, in the modified embodiment, the fine adjustment among the all the colors is executed after completing the rough adjustment mode.

Figure 6A:
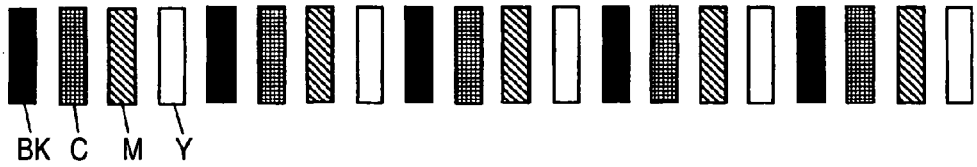
FIG. 6A shows an example of a fine adjustment mode.
Figure 6B:
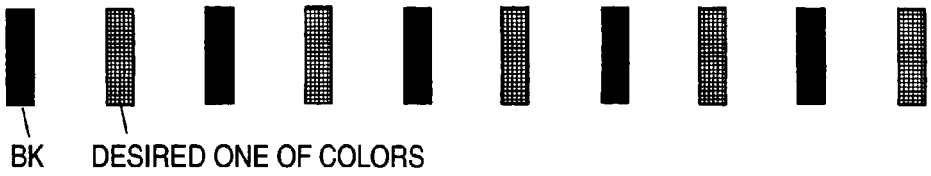
FIG. 6B shows an example of a rough adjustment mode.
Figure 7A:
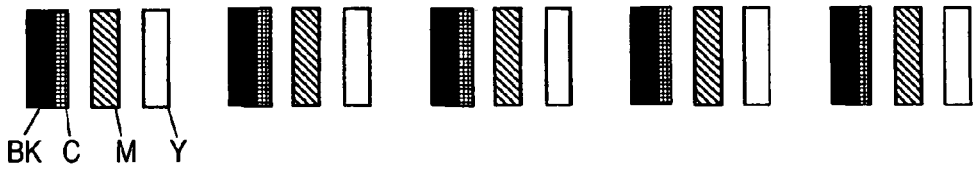
FIG. 7A shows an example of a misregistration between black and cyan.
Figure 7B:
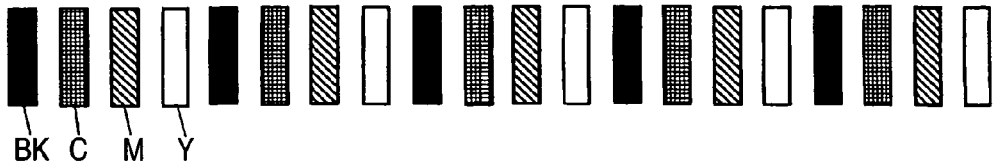
FIG. 7B shows an example of a fine adjustment mode after a rough adjustment mode.

FIG. 6A is a diagram for explaining a fine registration control. FIG. 6B is a diagram for explaining a rough registration control. FIG. 7A is a diagram for explaining an example of a misregistration between black and cyan. FIG. 7B is a diagram for explaining an example of a fine registration control after a rough registration control.

FIG. 6A shows an example of the fine adjustment mode among all the colors. Fine registration adjustment among all the colors is performed with registration marks of Bk, C, M and Y formed at regular intervals on the intermediate transfer belt. In this case, since the C, M and Y primary transfer rollers are driven integrally by the color contact/separation lever, misregistration rarely occurs. If this adjustment is performed frequently, registration marks of C, M and Y will be formed frequently in spite of good registration accuracy kept among C, M and Y. Thus, toners will be consumed uselessly, and it will take time for processing for the adjustment.

Therefore, as shown in FIG. 6B, first, the rough registration adjustment is performed between black and a desired one of the colors Y, M and C in which misregistration is apt to occur due to the different contact/separation levers for the primary transfer rollers. In the rough registration adjustment, registration with an increased interval between black and the one color is performed more roughly than that in the fine registration adjustment. When the rough registration adjustment is performed thus, the fine registration adjustment among all the colors in FIG. 6A can be also performed easily so that the color toner consumption can be suppressed and the processing time for registration adjustment can be also shortened. The standard color in the rough registration adjustment may be black or any one of the three colors.

When the misregistration between black and color is too large as shown in FIG. 7A, registration adjustment using the fine adjustment mode cannot adjust the misregistration. Even in such a case, registration adjustment can be performed easily when adjustment in the fine adjustment mode among all the colors as shown in FIG. 7B is performed after registration adjustment in the rough adjustment mode as shown in FIG. 6B is performed.

In the image forming apparatus in FIGS. 1, 2 and 3A-3C, the color with which adjustment with black is performed is preferably cyan. The cyan image former constituted by a photoconductor unit, a primary transfer roller, etc. is disposed in a position closest to the black one. It is therefore easy to increase the registration accuracy. Thus, it is preferable that registration is adjusted between black and cyan.

According to the first embodiment of the invention, the color toner consumption can be suppressed, and the processing time for registration adjustment can be shortened. Therefore, the invention has a large value in industrial applicability.

A second embodiment of the invention will be described below with reference to the accompanied drawings. The components identical with those in the first embodiment are denoted by the same reference numerals.

Figure 8:
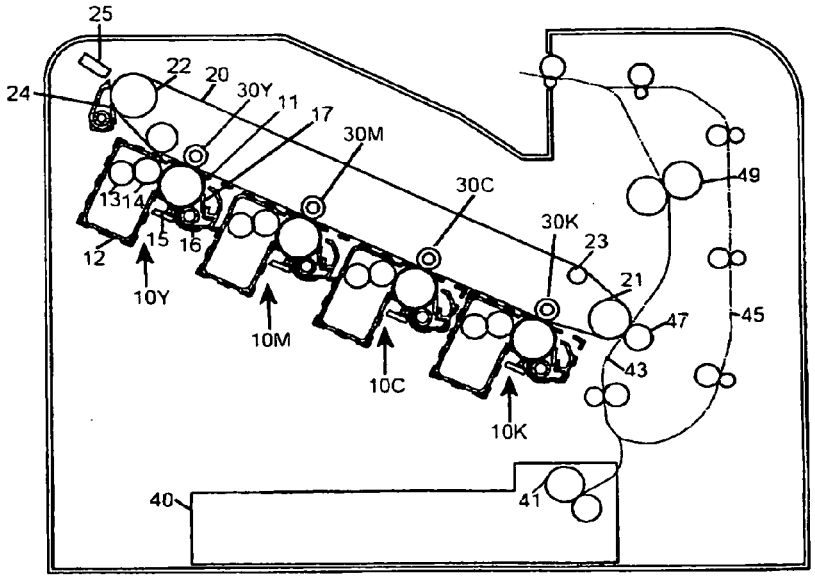
FIG. 8 is a diagram for explaining the schematic configuration of an image forming apparatus according to a second embodiment of the invention.

FIG. 8 is a view for explaining an embodiment of a tandem type color image forming apparatus to which the invention is applied.

In FIG. 8, in the image forming apparatus according to this embodiment, an endless intermediate transfer belt 20 is stretched between a driving roller 21 and a driven roller 22, and predetermined tension is applied to the intermediate transfer belt 20 by a tension roller 23. Four color photoconductor units 10 (a black photoconductor unit 10K, a cyan photoconductor unit 10C, a magenta photoconductor unit 10M and a yellow photoconductor unit 10Y) are disposed in the length direction of the intermediate transfer belt 20. An intermediate belt cleaner 24 is provided in a position opposed to the driven roller 22 while a registration sensor 25 for detecting a printing position is provided. Each color photoconductor unit 10 has a developing unit 12 having a toner supply roller 13 and a developing roller 14, an exposure unit 15, a charger 16 and a photoconductor cleaner 17 around a roller-like photoconductor 11. The photoconductor, the developing unit, the charger and the photoconductor cleaner excluding the exposure unit are integrated as an image forming cartridge, which is handled as expendable.

A primary transfer roller 30 for each color (a black primary transfer roller 30K, a cyan primary transfer roller 30C, a magenta primary transfer roller 30M, a yellow primary transfer roller 30Y) is disposed in a position opposed to each color photoconductor so as to put the intermediate transfer belt 20 therebetween. A secondary transfer roller 47 is provided in a secondary transfer position opposed to the driving roller 34 so as to put the intermediate transfer belt 20 therebetween.

In each color photoconductor unit 10, the photoconductor 11 is charged uniformly to predetermined potential by the charger 16, and image exposure is then performed thereon by the exposure unit 15 so as to form a pictorial electrostatic latent image on the photoconductor. The electrostatic latent image is developed by the developing roller 14 so as to form a toner image. The toner image is primarily transferred onto the intermediate transfer belt 20. Residual untransferred toner is cleaned up by the photoconductor cleaner 17. On the other hand, a paper feed cassette 40 is provided in a lower portion of the apparatus. Paper fed out by a feed roller 41 is conveyed through a conveyance path 43. In a secondary transfer position, toner images on the intermediate transfer belt are transferred onto the paper in a lump. After the secondary transfer, the toner images are fixed to the paper by a fixing unit 49, and the paper is then discharged to a tray on the top of the apparatus. In the case of duplex printing, the paper having the toner images printed on its front surface is conveyed to the secondary transfer position through a conveyance path 45, and toner images are transferred to the rear surface of the paper. After that, the toner images are fixed by the fixing unit 49, and the paper is discharged to the tray on the top of the apparatus.

In this embodiment, image forming cartridges of the cyan photoconductor unit 10C, the magenta photoconductor unit 10M and the yellow photoconductor unit 10Y are integrated as a color cartridge so as to suppress misregistration at the time of exchange of the color cartridge. However, since the monochrome cartridge and the color cartridge are separate, misregistration between black and color is apt to occur. It is therefore necessary to perform registration control at some timing after each image forming cartridge is removed and inserted for exchange of expendables or the like.

Next, registration control in the image forming apparatus having such a three-color-integrated color cartridge will be described with reference to FIGS. 2 and 3A-3B.

Figure 9:
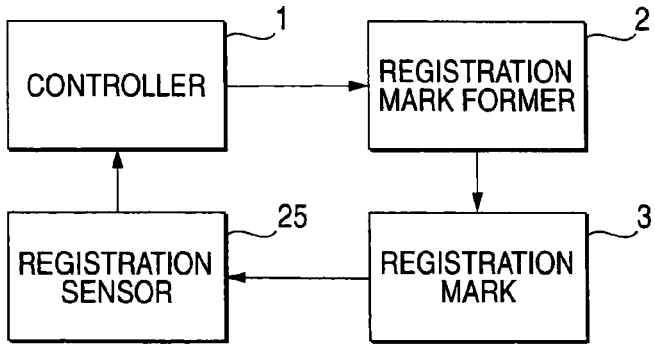
FIG. 9 is a block configuration diagram for registration control.
Figure 10A:
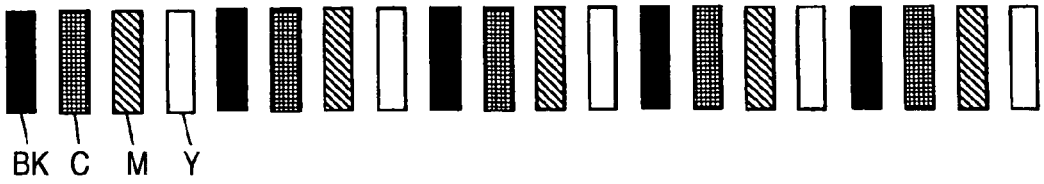
FIG. 10A shows an example of a full color adjustment mode.
Figure 10B:
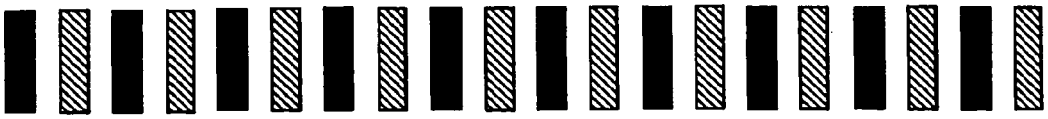
FIG. 10B shows an example of a two-color adjustment mode.

FIG. 9 is a block configuration diagram for the registration control. FIGS. 10A and 10B are diagrams for explaining the registration control.

The control unit 1 is a control portion for adjusting registration in the image forming apparatus. The control unit 1 is arranged as an independent stand-alone controller or a part of a controller for controlling a process as a whole. Registration adjustment is a process to prevent misregistration among images of respective colors formed on the intermediate transfer belt. For example, assume that exposure timing and driving speed of each color photoconductor, the driving speed of the intermediate transfer belt, etc. are set to form images (registration marks) of the respective colors Y, M, C and Bk at regular intervals on the intermediate transfer belt. In this case, the registration marks 3 actually formed on the intermediate transfer belt are read by the registration sensor 25 having a light emitting portion and a light receiving portion. The control unit 1 checks whether the registration marks 3 are formed at regular intervals or not. As a result, when the registration marks of the respective colors are not formed at regular intervals, the control unit 1 controls the registration mark forming means (the photoconductor units, the intermediate transfer belt, the intermediate transfer belt driving unit, etc.) so as to make the intervals equal to one another. By this control, for example, the timing of exposure in the exposure unit, the driving speed of each photoconductor, the driving speed of the intermediate transfer belt, etc. are adjusted. Although registration adjustment to form the registration marks at regular intervals has been shown here by way of example, the registration marks does not have to be formed at regular intervals. The registration marks may be formed with a desired pattern, and adjustment may be done to form the pattern conforming to settings. When adjustment can be done thus to form the registration marks conforming to settings, images can be formed without color misregistration among the respective colors.

In the image forming apparatus having the three-color-integrated image forming cartridge as shown in FIG. 8, misregistration among the colors Y, M and C rarely occurs. However, since the monochrome image forming cartridge is separate from the three-color-integrated image forming cartridge, misregistration between black and color is apt to occur. Therefore, in this embodiment, an adjustment mode to adjust registration between black and color is provided for performing registration control between black and color at some timing etc. after each image forming cartridge is removed and inserted, for example, at the time of exchange of the expendable.

FIG. 10A shows an example of a full color adjustment mode. Registration adjustment among the respective colors is performed with registration marks of Bk, C, M and Y formed at regular intervals on the intermediate transfer belt. In this case, since the C, M and Y image forming cartridges are integrated, misregistration rarely occurs. If this adjustment is performed frequently, registration marks of C, M and Y will be formed frequently in spite of good registration accuracy kept among C, M and Y. Thus, toners will be consumed uselessly, and it will take time for processing for the adjustment.

Therefore, as shown in FIG. 10B, there provided another mode for adjusting registration between black and color in which misregistration is apt to occur due to the separate image forming cartridges. Thus, adjustment is performed between black and a desired one of the colors Y, M and C, and the mode is changed over to the full color registration adjustment mode in accordance with necessity. The color toner consumption can be suppressed by the registration adjustment between black and one of the colors, and the processing time can be also shortened due to adjustment between the two colors as compared with adjustment among the four colors.

In such a manner, registration adjustment is performed by changing over between a first adjustment mode in which registration adjustment between black and color is performed with registration marks of black and one of the colors Y, M and C and a second adjustment mode in which registration adjustment is performed with registration marks of all the colors. Thus, the color toner consumption can be suppressed, and the processing time can be shortened.

In the image forming apparatus in FIG. 8, the color with which adjustment with black is performed is preferably cyan. The cyan image former is disposed in a position closest to the black image former. It is therefore easy to increase the registration accuracy when cyan is used. When only the registration adjustment between black and a specific color is performed frequently, the consumption of toner of the specific color increases. It is also necessary to determine the color with which registration adjustment with black is performed, in consideration of the consumption of color toners.

Further, a modified embodiment of the second embodiment will be described below with reference to the accompanied drawings.

In the modified embodiment of the second embodiment, the first adjustment mode in which in which registration adjustment between black and color is performed with registration marks of black and one of the colors Y, M and C is set to a rough adjustment mode and a second adjustment mode in which registration adjustment is performed with registration marks of all the colors is set to a fine adjustment mode. Further, in the modified embodiment, the fine adjustment among the all the colors is executed after completing the rough adjustment mode.

Figure 11A:
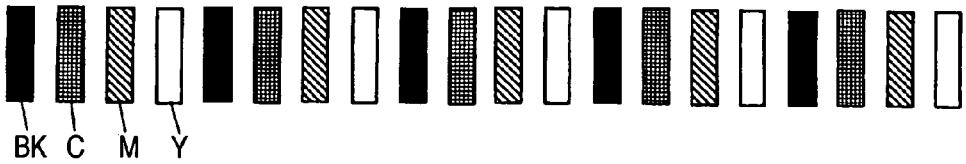
FIG. 11A shows an example of a fine adjustment mode.
Figure 11B:
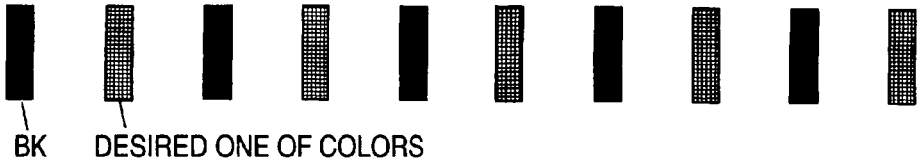
FIG. 11B shows an example of a rough adjustment mode.
Figure 12A:
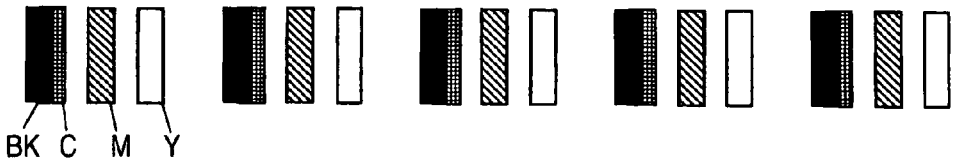
FIG. 12A shows an example of a misregistration between black and cyan.
Figure 12B:
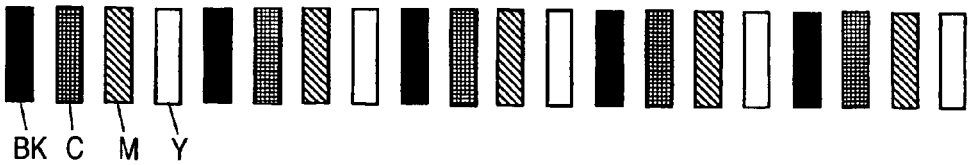
FIG. 12B shows an example of a fine adjustment mode after a rough adjustment mode.

FIG. 11A is a diagram for explaining a fine registration control. FIG. 11B is a diagram for explaining a rough registration control. FIG. 12A is a diagram for explaining an example of a misregistration between black and cyan. FIG. 12B is a diagram for explaining an example of a fine registration control after a rough registration control.

FIG. 11A shows an example of a fine adjustment mode of registration among all the colors. Fine adjustment of registration among all the colors is performed with registration marks of Bk, C, M and Y formed at regular intervals on the intermediate transfer belt. In this case, since the C, M and Y image formers are integrated as an image forming cartridge, misregistration rarely occurs. If this adjustment is performed frequently, registration marks of C, M and Y will be formed frequently in spite of good registration accuracy kept among C, M and Y. Thus, toners will be consumed uselessly, and it will take time for processing for the adjustment.

Therefore, as shown in FIG. 11B, rough adjustment of registration is first performed between black and a desired one of the colors Y, M and C in which misregistration is apt to occur due to the separate image forming cartridges. In the rough adjustment of registration, the interval between black and the one color is increased to perform registration adjustment rougher than that in the fine adjustment. In such a manner, due to the rough adjustment of registration performed in advance, the fine adjustment of registration among all the colors in FIG. 3A can be also performed easily. Thus, the color toner consumption can be suppressed, and the processing time for registration adjustment can be also shortened. The reference color in the rough adjustment of registration may be black or the one of the three colors.

When the misregistration between black and color is too large as shown in FIG. 12A, registration adjustment using the fine adjustment mode cannot adjust the misregistration. Even in such a case, registration adjustment can be performed easily when adjustment in the fine adjustment mode among all the colors as shown in FIG. 12B is performed after registration adjustment in the rough adjustment mode as shown in FIG. 11B is performed.

In the image forming apparatus in FIG. 1, the color with which adjustment with black is performed is preferably cyan. The cyan image former is disposed in a position closest to the black one. It is therefore easy to increase the registration accuracy. Thus, it is preferable that registration is adjusted between black and cyan.

According to the second embodiment of the invention, the color toner consumption can be suppressed, and the processing time for registration adjustment can be shortened. Therefore, the invention has a very large value in industrial applicability.

What is claimed is:

1. An image forming apparatus operable to select a first printing mode using a single color of toner or a second printing mode using at least two colors of toner, comprising a plurality of cartridges including: a first cartridge containing toner used in at least the first printing mode and second cartridges each containing toner used only in the second printing mode, each of the cartridges comprising an image former including a photo conductor adapted such that an electrostatic latent image is formed thereon and a developing member operable to develop the latent image as a visible toner image, an intermediate transfer belt, adapted such that the toner image is transferred thereon;

a first transfer member, operable to bring the intermediate transfer belt into contact with the photo conductor in the first cartridge;

a second transfer member, operable to bring the intermediate transfer belt into contact with the photo conductor in each of the second cartridges while the second printing mode is selected;

a registration mark former, operable to form registration marks on the intermediate transfer belt when an adjustment mode is effected, each of the registration marks being indicative of a reference position of the toner image formed by the image former in each of the cartridges;

a registration sensor, operable to detect a position of each of the registration marks; and a controller, operable to control the registration mark former to adjust a positional relationship between the registration marks associated with the first cartridge and one of the second cartridges based on the detected position, wherein the adjustment mode includes a first adjustment mode, in which the registration marks associated with the first cartridge and one of the second cartridges are formed; and a second adjustment mode, in which the registration marks associated with all of the cartridges are formed.

2. The image forming apparatus according to claim 1, wherein the registration marks used in the first adjustment mode are adjacent to each other.

3. The image forming apparatus according to claim 1, wherein the at least one of the second cartridges is selectably determined by the controller according to a residual amount of toner.

4. The image forming apparatus according to claim 1, wherein the single color of toner is black toner.

5. The image forming apparatus according to claim 1, wherein the at least two colors of toner includes yellow toner, magenta toner, and cyan toner.

6. The image forming apparatus according to claim 1, wherein the second adjustment mode effects a rough adjustment compared with the first adjustment mode, and the first adjustment mode is executed after the second adjustment mode is completed.

7. The image forming apparatus according to claim 6, wherein the registration marks used in the first adjustment mode are adjacent to each other.

8. The image forming apparatus according to claim 6, wherein the single color of toner is black toner.

9. The image forming apparatus according to claim 6, wherein the at least two colors of toner includes yellow toner, magenta toner, and cyan toner.

10. An image forming apparatus comprising:

a first cartridge including a first image former and a second cartridge including at least two second image formers, each of the image formers comprising a photo conductor adapted such that an electrostatic latent image is formed thereon and a developing member operable to develop the latent image as a visible toner image, an intermediate transfer belt, adapted such that the toner image is transferred thereon;

a registration mark former, operable to form registration marks on the intermediate transfer belt when an adjustment mode is effected, each of the registration marks being indicative of a reference position of the toner image formed by each of the image formers;

a registration sensor, operable to detect a position of each of the registration marks; and a controller, operable to control the registration mark former to adjust a positional relationship between the registration marks associated with the first image former and one of the second image former based on the detected position, wherein the adjust mode includes.

a first adjustment mode, in which the registration marks are formed by the first image former and one of the second image formers; and a second adjustment mode, in which the registration marks are formed by all of the image formers.

11. The image forming apparatus according to claim 10, wherein the registration marks used in the first adjustment mode are adjacent to each other.

12. The image forming apparatus according to claim 10, wherein the at least one of the second cartridges is selectably determined by the controller according to a residual amount of toner.

13. The image forming apparatus according to claim 10, wherein the first image former contains black toner.

14. The image forming apparatus according to claim 10, wherein the at least two second image formers contain yellow toner, magenta toner, and cyan toner.

15. The image forming apparatus according to claim 10, wherein the second adjustment mode effects a rough adjustment compared with the first adjustment mode, and the first adjustment mode is executed after the second adjustment mode is completed.

16. The image forming apparatus according to claim 15, wherein the registration marks used in the first adjustment mode are adjacent to each other.

17. The image forming apparatus according to claim 15, wherein the first image former contains black toner.

18. The image forming apparatus according to claim 15, wherein the at least two second image formers contain yellow toner, magenta toner, and cyan toner.

* * * * *